United States Patent [19]

Abramoska, Jr.

[11] 4,049,030

[45] Sept. 20, 1977

[54] VENT TUBE WITH REMOVABLE TIP FOR FILLING CONTAINERS

[75] Inventor: Alfred A. Abramoska, Jr., Medina, Ohio

[73] Assignee: Arthur Products Co., Medina, Ohio

[21] Appl. No.: 673,295

[22] Filed: Apr. 2, 1976

[51] Int. Cl.[2] ..... B65B 3/04

[52] U.S. Cl. ..... 141/286; 141/392; 285/DIG. 22

[58] Field of Search ..... 141/286, 392, 285, 367; 285/39, 319, DIG. 22

[56] References Cited

U.S. PATENT DOCUMENTS

| | | | |
|---|---|---|---|
| 1,401,302 | 12/1921 | Axelson | 285/39 |
| 3,455,350 | 7/1969 | Hinklage | 141/367 |
| 3,736,966 | 6/1973 | Dichiara | 141/286 |
| 3,774,658 | 11/1973 | Abramoska | 141/286 |
| 3,837,690 | 9/1974 | Fraser | 285/319 |

*Primary Examiner*—Houston S. Bell, Jr.
*Attorney, Agent, or Firm*—Bosworth, Sessions & McCoy

[57] ABSTRACT

A vent tube for a container filling machine in which the fill height is adjusted by the replacement of a removable lower tip. The vent tube has an upper tubular body with an interior axial passage through which gas is vented. The removable tip is attached to the body by insertion into a socket formed in the lower end of the passage. The tip is a tubular member with a wall surrounding an interior axial passage which communicates with the passage of the tube body. An opening is provided through the wall of the tip at the level of the predetermined fill height. Locking means are provided by which the tip is removably held within the socket of the tube body.

8 Claims, 10 Drawing Figures

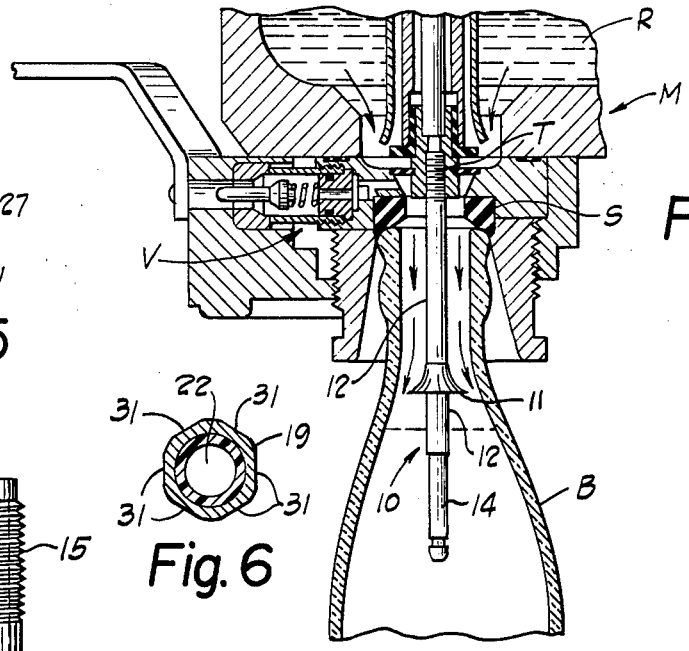
Fig. 1
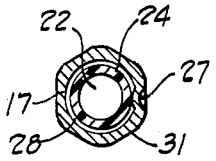
Fig. 5
Fig. 6
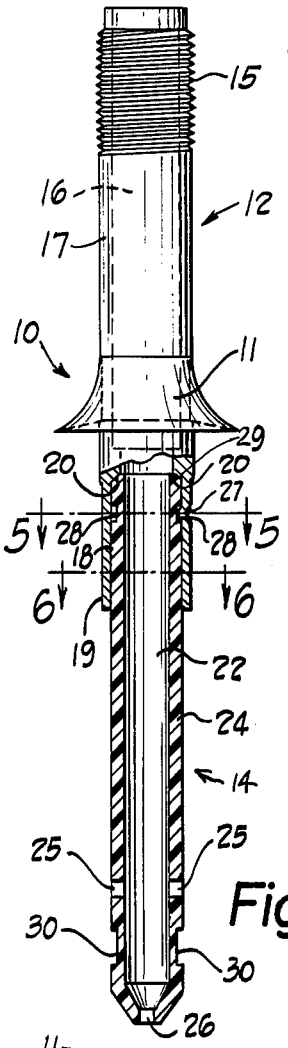
Fig. 2
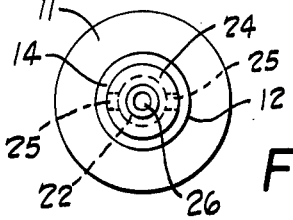
Fig. 3
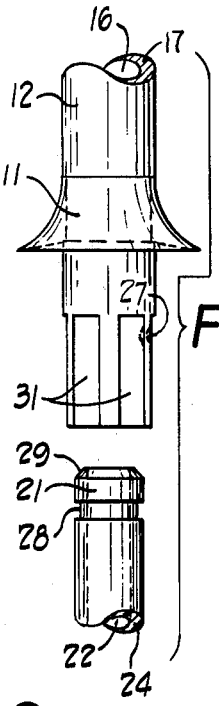
Fig. 4
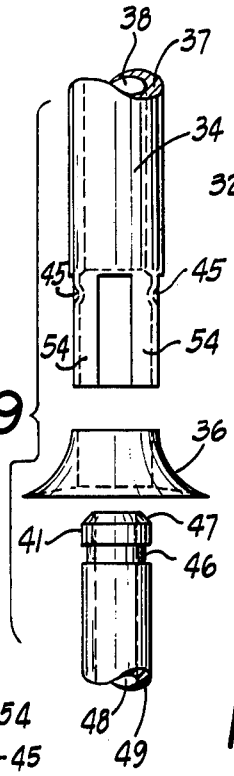
Fig. 9
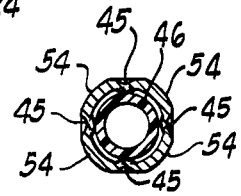
Fig. 10
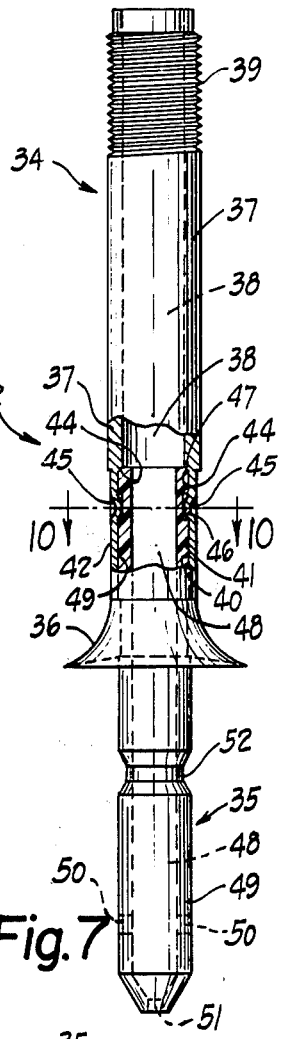
Fig. 7
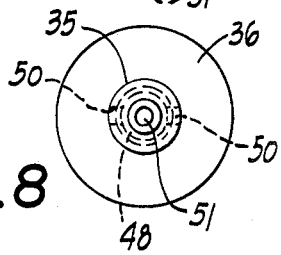
Fig. 8

VENT TUBE WITH REMOVABLE TIP FOR FILLING CONTAINERS

FIELD OF THE INVENTION

This invention relates to vent tubes for automatic container filling machines of the type that are widely used in the beverage industry for filling containers such as bottles, cans and the like.

BACKGROUND OF THE INVENTION

Automatic container filling machines involve a series of beverage dispensing valves and conveyor mechanisms which automatically operate to bring the containers to be filled into contact with the valves and seated against the valves, whereupon the beverage is automatically discharged into the containers. The containers are usually glass bottles or metal cans. Particularly when filling containers for carbonated soft drinks, beer, and the like, it is necessary to provide a vent for the gas in the containers. For this reason the filler valve mechanisms are provided with vent tubes which permit the gaseous contents of the containers to flow out of the containers as the liquid flows in. A central vent tube is associated with each valve, and is automatically inserted into the container by the machine before the filling is commenced, the vent tube projecting downwardly into the container.

Since the machines operate at high speeds, it is essential that the flow of liquid into each container be shut off when the containers are accurately filled to a desired level. Each vent tube acts not only to vent the gas from the container but also to accuate a mechanism for shutting off the flow of beverage into the container when the beverage reaches the desired level.

An example of a typical container filling machine is disclosed in U.S. Pat. 3,179,133. As disclosed in this patent, the height to which the container is filled is determined by the level of a vent aperture in the wall of the vent tube. This aperture is placed at the level of the desired fill height in the container. When the liquid in the container reaches the level of the fill height, it prevents the flow of gas into the vent aperture and through the interior passage of the tube. An automatic mechanism in the valve shuts off the flow of liquid into the container when the flow of gas has been blocked. There are various known types of valve mechanisms for filling machines that operate in this manner, and the construction of the valve mechanism per se does not form a part of this invention.

The fill height varies in different filling operations depending upon the size and shape of the containers and other factors. It is, therefore, necessary to adjust the level of the aperture in the vent tube. Various constructions of vent tubes have been proposed in order to provide the necessary adjustable vent aperature. For example, U.S. Pat. No. 3,179,133 shows a vent tube having an axially extending slot in the wall of the tube, and a snugly fitting sleeve disposed on the exterior of the tube that may be adjusted along the tube so as to close off the slot or slots in the wall of the tube above the level of the desired fill height. Vent tubes having exterior sleeves of this type, however, have serious problems. These sleeves are subject to damage by engagement with the bottles or other containers as they are moved into position for filling by the machine. In modern high-speed filling machines, engagement with the container is a particularly serious problem because of the possibility, not only of damage to the sleeves, but also of displacing the sleeves on the exterior of the vent tubes so as to change the position of the vent aperture. To prevent the possible displacement of the sleeve, it has been the practice to provide very tightly fitting sleeves on the exterior of the vent tube, making adjustment of the sleeves very difficult. Adjustment of the tightly fitted sleeves also causes the material to be roughened; fragments may be dislodged from the sleeve and fall into the container. The roughened sleeve also may result in undesirable foaming of the liquid being filled into the container. Foaming is particularly undesirable because it results in inaccuracy in the amount of product placed in the container. Furthermore, the range of adjustment of the exterior sleeve is limited by the placement of the spreader on the exterior of the sleeve.

To remedy some of the problems associated with the adjustable vent tubes of the prior art, I have disclosed in my co-pending patent application Ser. No. 624,010, filed Oct. 20, 1975, a vent tube with an internal controlling member disposed within the tube for blocking the passage of the flow of gas into an elongated slot on the wall of the tube. While this construction overcomes many of the problems associated with the prior art vent tubes, it still requires a tedious adjustment of the vent aperture by vertically moving the controlling member for each different filling operation.

A two-piece vent tube having an upper member or body and a removable lower member or tip has also been proposed. To adjust the vent aperture and the fill height, the tube tip is removed and is replaced by another tip having an aperture at a different level. This construction allows for rapid adjustment of the fill height by removal of one tube tip and replacement by a different one. The construction of prior two-piece vent tubes, however, has created problems in their use. The tube tip generally fits over the bottom end of the vent tube body. This connection may be subject to failure because the tube tips are often fabricated of relatively soft plastic to prevent damage to the containers during the insertion of the vent tubes. The soft plastic material of the tip may swell when wet and it may stretch by repeated placements over the bottom end of the tube body, and eventually the connection between the tip and the body can become loosened and the tip may fall off into the container during the filling process, or permit leakage of the gas into the interior passage of the vent tube after the liquid has reached the level of the vent aperture, causing the container to overfill.

Another problem with the two-piece vent tubes of the prior art concerns the design of the locking mechanism between the two pieces. The removable tip must be firmly secured to the vent tube body to prevent leakage and to prevent the tip from loosening during the filling process when it is subject to high speed flows of beverage and venting gas. For the locking mechanism between the two pieces to be sufficiently secure, a great deal of effort is required to remove the tip when exchanging one tip for another with an aperture at a different fill height. In order to grip the tube tip, pliers or other tools are often used to remove the tip, but such tools can cause damage to the tips if used repeatedly. Another method of removal was to place a tool, such as an ice pick, through the lateral vent apertures to pull off the tube tip. This method, however, may also result in damage to the tip, causing inaccurate fill heights.

SUMMARY OF THE INVENTION

These and other problems associated with the vent tubes of the prior art are overcome by the vent tube of the present invention. It is an object of the present invention to provide a vent tube with an improved removable tip, whereby adjustment for the fill height can be accomplished by exchanging one tip with another having a vent aperture at a different level. Another object is to eliminate the complicated means for adjusting the level of the vent aperture associated with the adjustable vent tubes of the prior art. Still another object is to provide a two-piece vent tube in which a tip made from a relatively soft material can be easily removed without damage to the tip. Yet another object is to provide a vent tube in which the tip fits into a socket in the bottom of the upper tube body, whereby the attachment is unlikely to wear out with swelling and continued use. Still another object is to provide a two-piece vent tube in which the spreader can be easily inspected or replaced.

These and other objects are accomplished by providing a vent tube with a removable lower member or tip attached to the bottom of an upper member or body by insertion of the upper end of the tip into a socket in the bottom of the body. Locking means are provided for holding the tube tip within the socket of the tube body. The tube tip comprises a wall surrounding an interior passage through which the gas is vented. The wall has an opening at a predetermined fill-height level by which the gas enters the passage. Preferably, a circumferential exterior groove is provided around the tip so that axial force can be applied by means of a tool to remove the tip from the socket of the body without damaging the tip. By insertion of the upper end of the tip into a socket in the bottom of the body, the vent tube of the present invention provides an attachment means in which the tip is less likely to wear out due to stretching and wear of the plastic material of the tip each time it is removed.

BRIEF DESCRIPTION OF THE DRAWINGS

FIG. 1 is a fragmentary vertical cross section of a valve mechanism of a container filling machine of conventional construction, except that it embodies a vent tube made according to the present invention.

FIG. 2 is an elevation partially sectioned to an enlarged scale, of the vent tube shown in FIG. 1.

FIG. 3 is an end elevational view of the vent tube of FIG. 2.

FIG. 4 is a fragmentary elevational view of a portion pf the vent tube of FIG. 2 showing the removal of the lower tip from the upper tube body.

FIG. 5 is a transverse cross sectional view of the vent tube of FIG. 2 taken along line 5—5 of FIG. 2.

FIG. 6 is a transverse cross sectional view of the vent tube of FIG. 2 taken along line 6—6 of FIG. 2.

FIG. 7 is an elevation with parts broken away of another embodiment of the vent tube of the present invention.

FIG. 8 is a bottom plan view of the vent tube of FIG. 7.

FIG. 9 is a fragmentary elevational view of the vent tube of FIG. 7 showing the removal of the tip and spreader from the tube body.

FIG. 10 is a transverse cross sectional view of the vent tube of FIG. 7 taken along line 10—10 of FIG. 7.

DESCRIPTION OF THE PREFERRED EMBODIMENTS

Referring to the drawings in more detail, FIG. 1 shows a portion of a filling valve of a conventional container filling machine, specifically a bottle filling machine. Since the vent tube of the present invention may be employed with a container filling machine of any known conventional construction, this valve will not be described here in detail. The bottle filling machine M has a reservoir R for the liquid to be filled. A valve mechanism V releases the liquid into a container such as a bottle B. The upper rim of the bottle is seated against an elastomeric seating ring S during the filling operation. As indicated by the arrows, the liquid flows through the valve mechanism and into the bottle B. The liquid flows around a vent tube 10 which is secured to the machine such as by threading into the bottle filling mechanism as indicated at T.

Conventionally, the vent tube is provided with a spreader 11 which may be composed of an elastomeric material or of stainless steel or other suitable metallic or plastic material. If desired the spreader 11 may be constructed as described and claimed in my prior U.S. Pat. No. 3,744,658, in which case the spreader is made to be freely movable along the vent tube.

The vent tube 10 is hollow with a central passage or bore. Conventionally, vent tubes have been provided with apertures at their lower ends. These apertures have often taken the form of lateral openings extending through the wall of the tube into the interior passage or bore of the tube. During the filling operation the gas displaced from the container by the liquid which enters the container, flows into the vent tube through the opening or openings therein and then through the interior venting passage or bore of the vent tube to the valve mechanism. As explained above, the valve mechanism V is designed so that when the liquid in the container reaches a level high enough to substantially prevent the flow of gas through the opening in the wall into the passage or bore of the vent tube, the filling machine valve mechanism automatically shuts off the flow of liquid into the container. By this method each container is accurately filled to a desired fill height which corresponds to the level of the opening in the vent tube. Also, as explained above, the desired fill height at which this action takes place must be adjusted for different sizes and shapes of containers, and perhaps also to compensate for other factors in the filling operation.

According to the present invention, the adjustment of the fill height is carried out simply and advantageously by providing a vent tube with a removable tip. An array of tube tips with openings at different levels can be provided, whereby the fill height can be adjusted by exchanging tips. The vent tube 10 of the present invention comprises an upper member or body 12 to which is attached a lower member or tip 14. An embodiment of the vent tube of the present invention is shown in more detail in FIG. 2.

The tube body 12 has means at its upper end for attachment to the container filling machine M, such as a threaded section 15. The body 12 has an internal axial bore or passage 16 surrounded by a tubular wall 17. At the lower end, a portion of the passage 16 is enlarged to form a socket 18 surrounded by a thinner section 19 of the wall 17. The socket portion 18 of the passage 16 extends axially inwardly from the open bottom of the tube body 12 to a shoulder 20.

The socket 18 is adapted to receive the upper portion 21 of the tube tip 14. The tip 14 has an internal, axially extending passage 22 through which the gas is vented. The passage 22 is surrounded by a tubular wall 24. The wall 24 is apertured to enable the gas in the container to escape into the passage 22 of the vent tube tip, preferably, by a lateral opening or openings 25. The position of the lateral openings 25 depends upon the desired fill height for the container being filled, since the valve mechanism V of the container filling machine will cease filling the container when the liquid reaches the level of the openings 25, and the venting of the gas is cut off. In addition to the lateral opening 25, an axial opening 26 may be provided at the bottom end of the tip 14. It is to be understood that the tip may also have a blunt end without the axial opening 26.

The means for holding the tube tip 14 within the socket 18 of the upper body 12 comprises an indentation in the wall 17 of the body (FIGS. 2 and 5) that provides an internal projection 27. The projection 27 engages a circumferential exterior groove 28 on the upper portion 21 of the tip 14 (FIGS. 2 and 4). When the upper portion 21 of the tip 14 is inserted into the socket 18 of the body 12, the projection 27 engages the groove 28 so as to secure the tip 14 in place and prevent it from moving axially. To provide adequate sealing between the passage 22 of the tip 14 and the passage 16 of the body 12, the top rim of the tip has a bevelled surface 29 which fits flush against the bevelled shoulder 20 of the body.

Removal of the tip 14 to permit the insertion of another tip having an opening at a different level, may be accomplished through the aid of a circumferential exterior groove 30 formed around the lower portion of the tip 14. The groove 30 enables one to place a tool, such as a slotted wrench, into the groove 30 and apply axial force to remove the tip 14. Upon the application of the axial force, the projection 27 is dislodged from the groove 28, freeing the tip.

To permit the body 12 to be easily attached to the threaded receiving portion T of the container filling machine, the lower portion of the body is provided with a plurality of flat exterior surfaces 31, which are preferably formed in a roughly hexagonal shape (FIG. 6). The surfaces 31 permit one to use a tool, such as a wrench, to turn the tube body 12 and attach the threaded section 15 to the portion T of the container filling machine, without damaging the tube body.

FIGS. 7–10 show another embodiment of the vent tube of the present invention having several variations of the basic design already discussed. This vent tube 32 is comprised of an upper member or body 34, a lower member or tip 35, and a spreader 36. The body 34 has a tubular wall 37 defining an internal axially extending passage 38 through which passes the gas being vented. At its upper end, the body 34 has a threaded section 39 for attachment to the container filling machine. At its lower end, the passage 38 opens into a socket 40 for the insertion of the upper portion 41 of the tip 35. The socket portion 40 of the passage 38 is surrounded by a thinner section 42 of the wall 37 and extends upwardly to a shoulder 44. Instead of the single indentation of the previous embodiment, this vent tube has a plurality of indentations and internal projections 45 in the wall portion 42 of the socket 40 (FIGS. 7 and 10). The additional projections hold the tip more securely than a single indentation 27.

At its upper portion 41, the tip 35 has a circumferential groove 46 which receives the projections 45 in the socket 40, and a bevelled surface 47 which sealingly fits against the bevelled shoulder 44 of the socket 40. The tip 35 has an internal axially extending passage 48 which communicates with the passage 38 of the body 34 to provide a continuous conduit for the gas being vented. The passage 48 is defined by a tubular wall 49. Lateral openings 50 are provided at the desired fill height to allow the gas to escape into the interior passage 48 of the vent tube tip, and to allow the passage 48 to be blocked when the liquid reaches the desired fill height. In addition, an axial opening 51 may also be provided at the bottom of the tip 35.

To facilitate removal of the tip 35, a circumferential groove 52 is provided on the exterior of the tip. To remove the tip 35 from the body 34, a tool, such as a slotted wrench, is positioned within the groove 52 and axial force is applied, disengaging the projection 45 from the groove 46, and freeing the tip 35.

As shown in FIG. 9, when the tip 35 is removed from the body 34, the spreader 36 is also easily removed. This permits inspection and replacement of the spreader, if necessary, each time a tip is exchanged to adjust the fill height.

As before, the lower portion of the tube body 34 is provided with a plurality of flat exterior surfaces 54. The surfaces 54 permit a tool, such as a wrench, to be used to turn the body 34 and install the threaded section 39 into the container filling machine without damage to the tube body.

The vent tube of the present invention has been shown with a locking means comprising either a single projection 27 or, a plurality of projections 45. It is understood, however, that other locking means may be used such as a circumferential ridge or a circular crimp applied with a roller in the wall of the tube body. The single projection 27 is preferred because it exerts sufficient force within the groove 28 to maintain the tip in firm engagement with the body 12, yet allows the tip to be easily removed without applying excessive force.

The tips 14 and 15 are preferably formed from a relatively soft resilient plastic material so that the possibility of damaging the bottles by chipping the bottle neck during insertion of the vent tubes is greatly reduced. Any swelling of the plastic when wet merely results in it being held more firmly in place, and the seal between the bevelled end of the tip and the internal shoulder of the metal body of the tube is improved. However, the tips may also be formed from stainless steel, if desired.

The two embodiments shown in FIGS. 1–6 and FIGS. 7–10 incorporate various different features of the present invention and it is possible to interchange these features. For example, the placement of the spreader 36 on the exterior of the tip 35 as shown in FIGS. 7–10 may by used in conjunction with the single dimple 27 of FIGS. 1–6, or the plurality of dimples 45 of FIGS. 7–10 may be used with the placement of the removal groove 30 of FIGS. 1–6.

Various other modifications, changes, and adaptions of the preferred forms of the invention may become evident to persons skilled in the art. The embodiments shown herein are for the purposes of illustration rather than limitation. Therefore, it is to be understood that this patent is not limited to the preferred forms described herein or in any manner other than by the scope of the following claims.

What is claimed is:

1. A vent tube for a container filling machine to be disposed within a container as it is being filled with liquid, which comprises:

a tubular body having a wall with an interior axially extending first passage through which gas may be vented as the container is being filled and having means for attachment to the filling machine at its upper end, said tubular body having a socket comprising a wall at its lower end for receiving a tip and said tubular body being provided with locking means for removably holding the tip in said socket; and a tubular tip comprising a wall surrounding an interior axially extending second passage for venting gas and having at least one opening in said wall at a predetermined level by which the gas being vented enters said second passage, said tip having lock engagement means for removably attaching said tip to said tubular body at a predetermined level by insertion into said socket and into engagement with said locking means, and said tip being adapted to be removably held at said predetermined level in said socket by said locking means.

2. A vent tube as recited in claim 1, wherein said tip has a circumferential exterior groove by which axial force may be applied to remove said tip from said body.

3. A vent tube as recited in claim 1, wherein said locking means comprises a projection on the wall of said body extending inwardly form the interior socket wall, said projection engaging a corresponding groove on the exterior of said tip.

4. A vent tube as recited in claim 1, wherein said body has flat surface portions over segments of its exterior surface for engagement of said body with a tool to remove and attach said body from and to the filling machine.

5. A vent tube as recited in claim 1, comprising in addition a spreader mounted on the exterior surface of said body.

6. A vent tube as recited in claim 1, comprising in addition a spreader mounted on the exterior surface of said tip below the portion of said tip which is inserted into said socket.

7. A vent tube as recited in claim 1, wherein said locking means comprises an inwardly extending circumferential ridge on the interior wall of said socket, said ridge engaging a corresponding circumferential groove on the exterior of said tip.

8. A vent tube as recited in claim 1, wherein said tip is made from a plastic material.

* * * * *